United States Patent [19]

Johnson et al.

[11] Patent Number: 4,617,603

[45] Date of Patent: Oct. 14, 1986

[54] DEGAUSSING SYSTEM FOR BULK DEMAGNETIZATION OF PREVIOUSLY MAGNETIZED MATERIALS

[75] Inventors: Ronald R. Johnson, Shorewood; Randall K. Rieckenberg, Minneapolis, both of Minn.

[73] Assignee: IXI Laboratories, Inc., Shorewood, Minn.

[21] Appl. No.: 706,134

[22] Filed: Feb. 27, 1985

[51] Int. Cl.[4] ..... H01F 13/00

[52] U.S. Cl. ..... 361/149; 361/205; 361/267

[58] Field of Search ..... 361/149, 150, 151, 205, 361/267

[56] References Cited

U.S. PATENT DOCUMENTS 4,158,873 6/1979 Schroeder et al. ..... 361/149

4,360,854 11/1982 Schergen et al. ..... 361/149

4,373,174 2/1983 Akesson ..... 361/149

4,384,313 5/1983 Steingroever et al. ..... 361/149

4,423,460 12/1983 Jackson et al. ..... 361/151

*Primary Examiner*—Michael L. Gellner

*Attorney, Agent, or Firm*—Orrin M. Haugen; Thomas J. Nikolai

[57] ABSTRACT

The item to be demagnetized is placed in a chamber surrounded by electrical windings defining a pair of coils that are disposed in a mutually orthogonal configuration. Currents for the two coils are developed in a microprocessor-controlled inverter circuit and are applied through semiconductor switches in such a way that the resulting demagnetizing field is rotating and follows a predetermined amplitude variation in accordance with one or more profiles stored in the memory of the microprocessor.

7 Claims, 6 Drawing Figures

DEGAUSSING SYSTEM FOR BULK DEMAGNETIZATION OF PREVIOUSLY MAGNETIZED MATERIALS

BACKGROUND OF THE INVENTION

I. Field of the Invention:

This invention relates generally to apparatus for the bulk demagnetization of items exhibiting a remanent magnetic field, and more particularly an improved system for uniformly and efficiently demagnetizing items possessing a remanent magnetic field on a high volume, by subjecting the item to a demagnetizing field which rotates and which increases from essentially a zero amplitude to a predetermined maximum and then again decreases to a zero amplitude. This type of field profile is deemed ideal as far as its ability to leave the item in a completely demagnetized state.

II. Discussion of the prior Art:

In the Jackson et al U.S. Pat. 4,423,460, there is described an apparatus for the bulk erasing of magnetic recording media, such as magnetic recording tape used to store audio, video and digital information. It is the intent of that apparatus to leave the magnetic domains on the tape in a random orientation so that subsequent recording will take place on a "clean slate". As is pointed in the Jackson et al patent, noise is introduced into the recording process if the information signals to be recorded are imposed on a magnetic media that already has its domains uniformly oriented in given areas. The apparatus of the Jackson et al patent comprises a two piece, multi-legged iron core structure where each leg includes windings thereon with the diametrically opposing pairs of legs in each core being wound for opposite magnetic polarity. The windings are arranged to be energized from an alternating current 60 Hz supply through a phase shifting circuit so that, ideally, the current supplied to one pair of legs is 90° out-of-phase with respect to the current applied to the windings on the other pair of legs. This results in the production of a rotating magnetic field in the gap between the apposed faces of the legs of the two cores. The windings are continuously energized by the AC source and the item to be demagnetized is made to pass, via a conveyor or the like, through the rotating magnetic field. According to the theory given in the Jackson et al patent, the field strength to which the item being demagnetized is subjected supposedly rises from zero as the item enters the field, reaches a maximum when the item is centered between the two cores and then decreases to zero as the item passes out of the influence of the magnetic field. In practice, however, a device built in accordance with the teachings of that patent will not yield the ideal demagnetizing field characteristic described above. The Jackson patent also suggests that a controlled variation in the demagnetizing field strength can be obtained by locating the item to be demagnetized between the apposed pole pieces and then moving those pole pieces apart to reduce the applied field toward zero. Because such operation necessarily varies the mutual inductance of the field coils, it will introduce unwanted variations in the uniformity of the rotating field.

It is well recognized that a rotating magnetic field can be produced by applying sinusoidal currents to two magnetic structures which are physically arranged to create mutually orthogonal magnetic field vectors when the AC currents are 90° out-of-phase with respect to one another, e.g. induction electric motors. However, to produce a perfectly uniform rotating field, it is necessary that the magnitude of the currents be identical. Also, they must be supplied exactly 90° out-of-phase with respect to one another. When a rotating field is to be used to demagnetize magnetic recording media, such as diskettes, magnetic tape cassettes, disk packs and the like, it is essential to proper demagnetization that the rotating field be perfectly uniform. Otherwise, non-uniformities in the material's erasure results.

The circuit of the aforereferenced Jackson et al patent utilizes capacitive reactance to produce the desired 90° phase shift. The capacitor $C_1$ in FIG. 4 is selected to produce a 45° phase shift while capacitor $C_2$ is selected to produce a 135° sic (315°) phase shift, resulting in the desired 90° phase difference in the two coil system.

A reactive component will, of course, shift the phase between line voltage and line current by plus or minus 90° depending upon the nature of the component (capacitor or inductor). A dissipative component (a resistor) does not shift the relative phase between line voltage and line current at all. The combination of a resistor and a reactive component will produce a phase shift between zero and plus or minus 90°. The magnitude of the phase shift in this latter case is dependent not only on the value of the components, but on the frequency of the applied voltage. It is apparent, therefore, that the circuit of the Jackson patent relies upon resistive elements in the circuit, even though they are not explicitly shown. The uniformity of the magnetic field developed by the system of the Jackson patent is thus dependent upon the precision of the values of his reactive components and the stability of the line frequency. The incorporation of the dissipative elements, of course, also creates power loss in the form of heat. Short term heating effects and long term aging effects tend to change the values of the components employed, causing degradation of the symmetrical (circular) nature of the rotating demagnetizing field. As mentioned, variations in the line frequency will also cause the rotating demagnetizing field to deviate from circular.

The resistive elements employed in the phase shift circuitry of the Jackson et al patent are also wasteful of power and reduce the efficiency of the machine. Because the Jackson system utilizes ferrous metal cores in the demagnetizing assembly, this adversely impacts efficiency, versatility and the quality of the demagnetization process. Specifically, when ferrous materials are exposed to an AC magnetic field, eddy currents result and hysteresis losses occur which result in heating and a general loss of efficiency. Because ferrous materials exhibit a saturation point, they limit the magnitude of the field which may be generated. The ferrous core pieces of the Jackson patent also introduce hysteresis effects which tend to distort the sinusoidal magnetic field through the introduction of third harmonics. It is found that these third harmonics invariably detract from the quality of the erasure process.

A still further drawback of the system of the Jackson et al patent centers around the use of ferrous metal pole pieces which create areas of increased flux density proximate the poles. These nonuniformities, i.e., "hot spots", decrease the quality of the erasure and oftentimes leaves the magnetic domains in the material in other than a purely random state. For example, when an item, such as a reel of recording tape, to be demagnetized is made to pass between the apposed core pieces upon which the field windings are arranged, as it passes between the trailing pole pieces, it will not be subject to a rotating field, but only to a strong sinusoidal magnetic field because the coil pair producing the quadrature field is now at a considerable distance from the item being treated. As a result, the item being erased is actually subject to a remagnetizing field upon exit from the system.

The system of the present invention obviates all of the foregoing deficiencies of the prior art as represented by the Jackson et al patent. The demagnetization system hereindescribed is virtually impervious to variations in line frequency since the energy used in the demagnetization process is first stored as a DC voltage and then converted through a microprocessor-controlled inverter circuit to an AC current of a precise frequency, independent of the frequency supplied by the power company. The microprocessor used in the system of the present invention monitors the operation of the system to insure a 90° phase shift between the energizing currents flowing through the orthogonal field windings. Thus, the system is immune from loss of uniformity in the rotating demagnetizing field vector due to component value drift and ferrous metal introduction. Also, as will become apparent as the description of the preferred embodiment is presented, the demagnetization system of the present invention uses no dissipative elements (resistors) in the high power section, resulting in extremely high efficiency and low power consumption. Furthermore, the system of the present invention can operate at any level of magnetizing force because the field is not limited by the saturation characteristics of the particular iron alloy used in the fabrication of pole pieces as in prior art systems. It may operate at any frequency or any phase shift between coils and on any size items to be demagnetized or any field strength, subject only to the state-of-the-art of power switching technology.

Because the system of the present invention operates at a frequency considerably higher than the 60 Hz current supplied by the power company, the demagnetization process can take place at a substantially greater rate than systems which merely utilize line power, thus increasing the processing rate of the equipment.

SUMMARY OF THE INVENTION

The present invention comprises a hollow spherical core made from a non-ferromagnetic material, such as plastic, upon which are wound first and second field coils, the coils being physically deployed orthogonally with respect to one another. Thus, the interior of the spherical core defines a chamber in which the items to be demagnetized are to be placed. The two separate coils surrounding the chamber each form one element of a pair of resonant tank circuits. The tank circuits are, in turn, arranged to be driven by a DC to AC inverter through a transformer coupling and the amount of energy delivered to the two tank circuits is controlled by appropriately timed firing of solid-state switching circuits disposed in series between the transformer secondary and the tank circuits.

Furthermore, the two tank circuits are energized so as to produce fields which are out-of-phase with respect to one another by a predetermined phase angle. Hall sensors are used to detect the instantaneous amplitude of the magnetic field produced by the respective tank circuit coils and the resulting signal is fed back to a microprocessor-based control circuit where the signal proportional to the magnitude of the field is compared to a desired field amplitude profile and the timing of the firing of the solid-state switches are accordingly controlled. In this fashion, there is developed within the chamber surrounded by the orthogonal coils a demagnetizing field vector which may increase and decrease in amplitude in accordance with a predetermined time profile stored in the microprocessor's memory and which also rotates either circularly or elliptically depending upon the particular manner in which the microprocessor controller is programmed. When bulk materials exhibiting residual magnetization are placed in the chamber and subjected to such fields, the residual magnetization may be effectively reduced to zero or to any other desired value.

OBJECTS

It is accordingly a principal object of the present invention to provide an improved apparatus for degaussing bulk materials.

A still further object of the invention is to provide a demagnetizing technique that is intrinsic, i.e. where the same concept can be used to achieve any level of magnetic force, now or in the future, as magnetic material energy products improve.

Another object of the invention is to provide an electronic circuit for producing a composite demagnetizing field within an enclosed chamber where the demagnetizing field both rotates and follows a predetermined amplitude/time profile.

Another object of the invention is to provide a demagnetizing system in which bulk materials to be demagnetized may be stationary during the demagnetizing cycle.

Still another object of the invention is to provide a demagnetizing system in which both the amplitude and phase characteristics of the demagnetizing field are controlled by a microprocessor.

Yet another object of the invention is to provide a demagnetizing system which is void of dissipative elements and which is immune to variations in power line frequency and the reactance of the components used therein.

These and other objects and advantages of the invention will become apparant to those skilled in the art from the following detailed description of a preferred embodiment, when considered in conjunction with the accompanying drawings in which like numerals in the several views refer to corresponding parts.

DESCRIPTION OF THE PREFERRED EMBODIMENT

Figure 1:
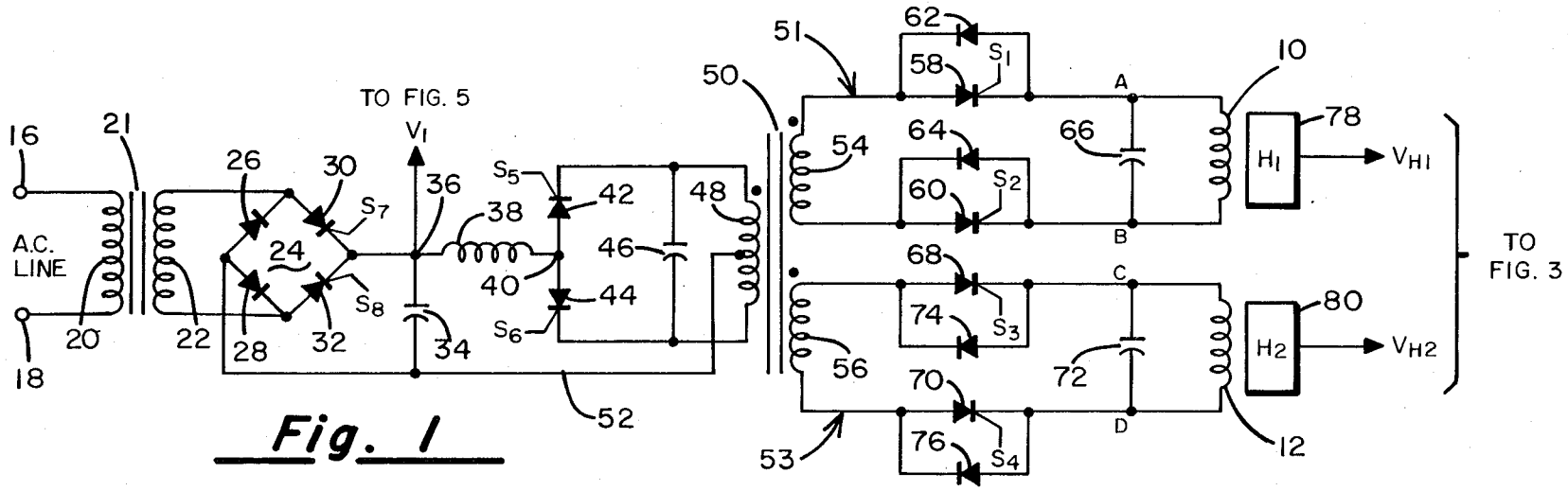
FIG. 1 is an electrical schematic diagram representing the apparatus for driving the demagnetizing field coils.
Figure 2:
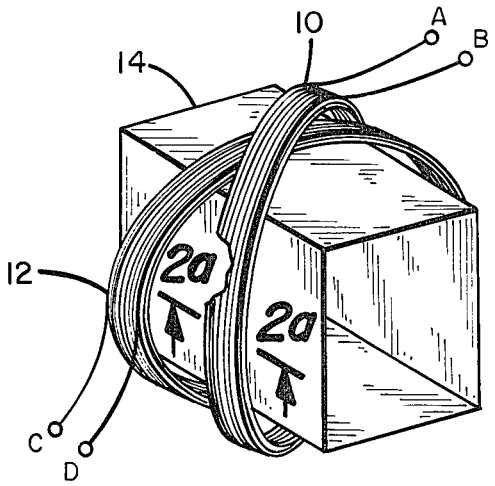
FIG. 2 illustrates the coil configuration surrounding the demagnetizing chamber.
Figure 2A:
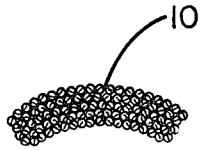

Referring to FIGS. 1 and 2, there is shown an electrical schematic diagram of the field coil driving circuitry and the physical orientation of the field coils in accordance with the present invention. The field coils 10 and 12 are wound so as to conform to a generally spherical core 14 and are disposed about a chamber made of insulating material. The turns comprising the coil 10 are orthogonally disposed relative to the turns comprising the coil 12 when positioned about the demagnetizing chamber. When currents out-of-phase with respect to one another are made to flow through windings 10 and 12, a rotating magnetic field is produced within the interior of the chamber and, when the phase angle between the respective currents flowing in the windings 10 and 12 is 90°, the resultant magnetic vector traverses a circular path.

The circuit of FIG. 1 is adapted to be energized by connecting it to a source of AC line current, such as a 60 Hz supply provided by the power company. The 110 or 220 volt 60 Hz supply is adapted to be connected across the terminals 16 and 18, which are respectively connected to opposite ends of the primary winding 20 of a power supply transformer 21. The secondary winding 22 of the power supply transformer 21 is connected across the input terminals of a full-wave bridge rectifier 24 which comprises diodes 26 and 28 and semiconductor switching devices (SCRs) 30 and 32. The gate or trigger electrode of the SCR 30 is labeled $S_7$ while the trigger electrode for the SCR 32 is labeled $S_8$.

Connected across the output of the full-wave bridge rectifier 24 is an energy storage device in the form of a capacitor 34. One terminal of the capacitor 34 is tied to a junction point 36 to which an inductor or choke 38 is also connected. The other terminal of choke 38 is connected to a junction point 40 between the anode electrodes of a further pair of semiconductor switching devices (SCRs) 42 and 44. The gate electrodes for the switching devices 42 and 44 are labeled $S_5$ and $S_6$, respectively. The cathode electrodes of the SCRs 42 and 44 are individually connected to opposite terminals of a capacitor 46 and connected in parallel with that capacitor is the primary winding 48 of a transformer 50. The primary winding 48 is center tapped and a conductor 52 connects that center tap back to the remaining output terminal of the full-wave bridge rectifier 24.

The transformer 50 has two secondary windings 54 and 56 which are wound so as to produce voltages thereacross whose polarities are in accordance with the dot convention indicated. The upper secondary winding 54 is arranged to drive the field coil 10 through triggerable semiconductor switching devices, such as SCRs 58 and 60, which are connected in series therewith. Connected in parallel with the switching devices 58 and 60 are diodes 62 and 64, which serve to complete the current path through the SCR devices once they have been rendered conductive. The gate or trigger electrode of the switching device 58 is identified by numeral $S_1$ while that of device 60 is identified by the label $S_2$. A capacitor 66 whose component value is selected so as to cause resonance with the field coil 10 is connected directly in parallel with that field coil.

In much the same fashion, the lower secondary winding 56 of the transformer 50 is coupled through solid-state, triggerable, switching devices 68 and 70 to the field winding 12 and a capacitor 72 is connected in parallel with the field winding 12 and is sized so as to produce resonance therewith. Again, diodes 74 and 76 are connected in parallel and are poled in a direction opposite to the semiconductor switching devices 68 and 70 so as to provide the commutation function. As is illustrated, the trigger electrodes for the semiconductor switching devices 68 and 70 are labeled $S_3$ and $S_4$, respectively.

Magnetic field sensors in the form of Hall-effect devices 78 and 80 are disposed proximate the field coils 10 and 12 to produce voltage signals $V_{H1}$ and $V_{H2}$ which are proportional to the instantaneous magnetic field strength produced by the coils 10 and 12.

Figure 3:
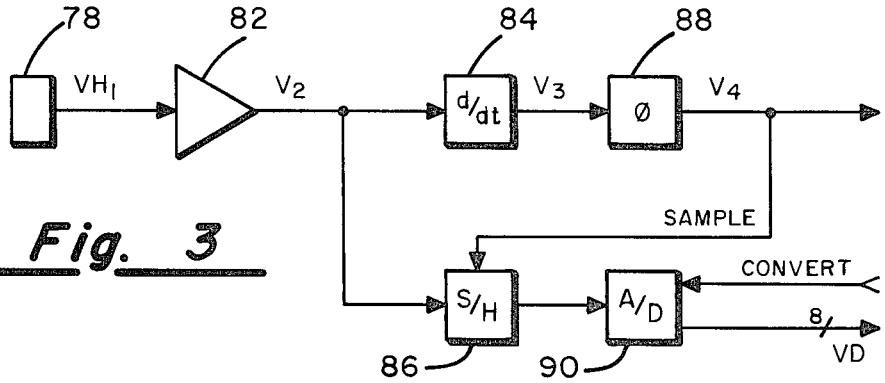
FIG. 3 is a block diagram of the field sensing circuitry in the embodiment of FIG. 1.
Figure 4:
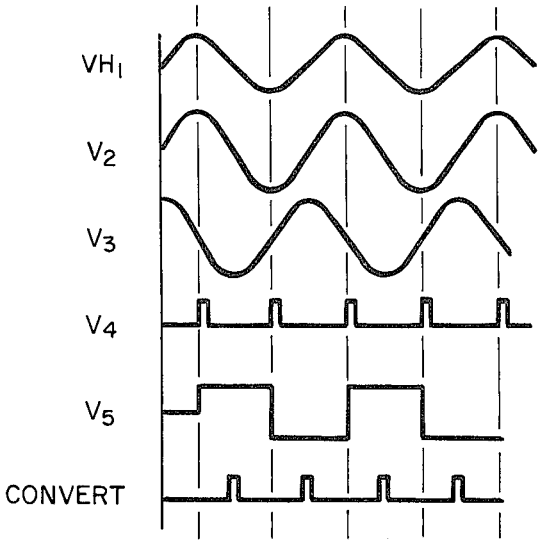
FIG. 4 is a waveform diagram helpful in understanding the operation of the feedback circuit of FIG. 3.

FIG. 3 is a schematic block diagram of the signal processing circuitry associated with the Hall sensor elements 78 and 80 of FIG. 1. The circuit shown in FIG. 3 is replicated for each of the Hall sensors, although for purposes of explanation, only one such signal processing circuit is described. The voltage signal $V_{H1}$ emanating from the Hall sensor 78 is amplified at 82 to produce a time varying signal $V_2$ (FIG. 4) at the output thereof. This signal is applied to the input of a differentiating circuit 84 and to the input of a sample and hold circuit 86. The output signal $V_3$ (FIG. 4) from a differentiator 84 is applied as an input to a zero-crossing detector 88 and its output is, in turn, applied to the "sample" terminal of the sample and hold circuit 86. The output from the sample & hold circuit 86 is identified by the label $V_5$ and is applied to the input of an analog-to-digital converter 90. The waveform of the signal $V_5$ is also illustrated in FIG. 4. Upon command from the microprocessor (FIG. 5), the A/D converter 90 converts the analog signal $V_5$ to a digital value $V_D$ which is conveyed over the 8-bit data bus to the microprocessor.

Referring to the waveform diagram of FIG. 4, the signal $V_2$ is an amplified version of the variation of the output $V_{H1}$ from the Hall sensor 78 occasioned by changes in the magnetic field being sensed by that element. Differentiation of the waveform $V_2$ leads to the waveform shown as $V_3$. This waveform passes through zero at each maximum and minimum of the waveform $V_2$. The zero-crossing detector 88 produces a spike at each transition of the waveform $V_3$, either from positive to negative or from negative to positive. The signals $V_4$ from the zero-crossing detector 88, when applied to the "sample" input of the sample and hold circuit 86, captures the amplitude of the signal $V_2$ at the moment of occurrence of the $V_4$ pulse and it is held until the next "sample" input occurs. As is indicated in FIG. 4, the CONVERT command from the microprocessor to the A/D converter 90 is timed to occur within each discrete sample interval. The output from the A/D converter is an 8-bit digital quantity indicative of the voltage amplitude of the signal $V_{H1}$ at the moment it is captured in the sample and hold circuit 86.

Figure 5:
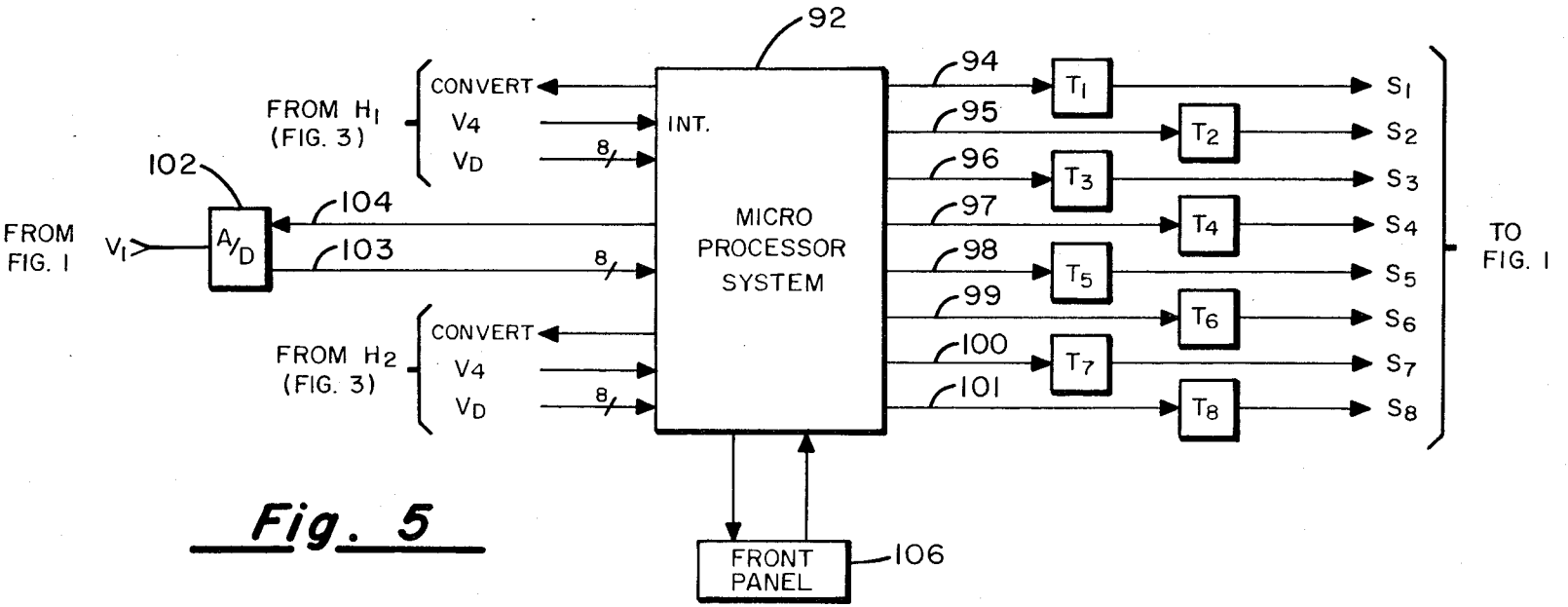
FIG. 5 is a schematic diagram of the microprocessor control system for controlling the switching of the SCR components utilized in the circuit of FIG. 1.

Having described the circuit for driving the field winding and the sensing circuit for monitoring the magnetic field strength produced by the orthogonal windings, attention will next be directed to the microprocessor control circuitry used to time the switching of the various semiconductor switches used in the circuit of FIG. 1. In this regard, reference is made to FIG. 5. In FIG. 5, there is represented by a block 92 a microprocessor system which may include a CPU and associated RAM and ROM memories intercoupled therewith in a known bus-structured fashion. With no limitation intended, the microprocessor system may comprise a Type 8085 manufactured and sold by Intel Corporation of Cupertino, Calif. and, as such, may be an 8-bit device. While not specifically illustrated, it is to be understood that the microprocessor system 92 includes a memory for storing operands and a program of instructions executable by the CPU in accordance with a stored program. As is more fully set out in the application notes published by Intel Corporation and relating to its Type 8085 microprocessor, it includes a number of addressable registers which may be loaded with preset values read from the system's memory and then counted down by the microprocessor's internal clock to perform a plurality of precision timing functions. In FIG. 5, the timing signals are shown as being emitted on the lines 94–101 and are applied via level setting trigger circuits $T_1$ to $T_8$ to the SCR gate electrodes $S_1$ to $S_8$ illustrated in the circuit diagram of FIG. 1.

Each of the Hall sensors 78 and 80, working through a signal processing circuit such as in FIG. 3, provides input to the microprocessor system 92. Specifically, the "sample" signal emanating from the zero-crossing detector 88 may be applied as a Request to the microprocessor whereas the 8-bit output from the A/D converter 90 is applied to the microprocessor via its input data bus. A CONVERT command is sent from the microprocessor's Acknowledge output to the A/D converter 90 at an appropriate time followiong the occurrence of the "sample" signal so that it is assured that the contents of the sample and hold circuit 86 are stable and indicative of the Hall sensor output at the time of occurrence of the zero-crossing of the differentiated and amplified output from that sensor.

The voltage developed across the energy storage capacitor 34 in the power supply portion of the circuit of FIG. 1 is applied to a further A/D converter 102, which is effective to convert that amplitude to an 8-bit digital quantity indicative of the DC energy available. The conversion occurs at the time that the microprocessor system 92 outputs a CONVERT signal on line 104.

To provide operator interface with the demagnetizing system of the present invention, a front panel 106 which may include various switches and displays is coupled to the microprocessor in a conventional fashion.

Having described the constructional features of the circuit comprising the preferred embodiment of the present invention, consideration will next be given to its mode of operation.

OPERATION

Referring to FIGS. 1 and 2, the item or. items to be demagnetized may be placed in or conveyed to a hollow air core chamber 14 and the terminals 16 and 18 are plugged into a source of alternating current line voltage. The full-wave rectifier bridge 24 along with the filter capacitor 34 comprise a DC supply, and the voltage at any time appearing across the capacitor 34 is identified as a voltage $V_1$ and is applied to the analog-to-digital converter 102 of FIG. 5. The A/D converter 102 develops a binary word on the 8-bit data bus 103 under control of the CONVERT command issued by the microprocessor. The microprocessor is programmed to determine whether the DC voltage across the capacitor 34 is greater than, equal to or less than a predetermined value and if less than, the microprocessor applies appropriate timing signals via the trigger circuits $T_7$ and $T_8$ to the SCR devices 30 and 32 to feed more current to the energy storage capacitor 34. On the other hand, if the magnitude of the voltage $V_1$ is greater than a predetermined value, charge is allowed to bleed off of the capacitor 34 until the desired voltage is maintained.

The combination of the choke 30 of the SCRs 42 and 44, the capacitor 46 and the primary winding 48 of the transformer 50 comprise a well-known McMurry/Bedford inverter which is used to convert the energy from the DC power supply into high frequency square waves. The square waves are then coupled through the transformer 50 into the two field profile control circuits 51 and 53 which serve to control the energy delivered to the two resonant tank circuits comprised of field coil 10 and capacitor 66 and field coil 12 and capacitor 72. As will be explained in greater detail below, by properly controlling the conduction of the semiconductor switching devices 58–60 and 68–70, a rotating field of a controlled amplitude profile can be created in the orthogonally disposed coils 10 and 12.

Referring to the inverter portion of the circuit of FIG. 1, when SCR 42 is rendered conductive by the application of a trigger pulse $S_5$ to the gate electrode thereof, current will flow to the primary winding 48 of the transformer 50. The full supply voltage is applied across the top half of the transformer primary winding 48. Due to autotransformer action, a total of twice the DC supply voltage $V_1$ is developed across the entire primary winding and the capacitor 46 is thus charged to twice the supply voltage. Now, when SCR 44 is triggered, the capacitor 46 is effectively placed directly across SCR 42 such that the voltage stored on the capacitor 46 reverse biases SCR 42, causing it to turn off. SCR 44 now conducts the entire supply current, causing it to flow in the opposite direction through the transformer primary winding whereby capacitor 46 now recharges in the opposite direction from before. When SCR 42 is again triggered, the voltage on the capacitor 46 will be connected directly across the SCR 44 to extinguish it, with the cycle repeating.

What are produced then are square waves of current through the primary winding of the transformer 50. These pulses are of a relatively high repetition rate as compared to the resonant frequency of the tank circuits which are ultimately driven by the current pulses. Typically, the microprocessor may be programmed to generate the trigger pulses $S_5$ and $S_6$ such that square wave pulses are produced at about an 8 KHz rate.

These current square waves are coupled through the pulse transformer 50 and are used to excite the resonant tank circuit, including coil 10 and capacitor 66 and the tank circuit including coil 12 and capacitor 72. The amount of energy coupled into the tank circuit is controlled, however, by the timed firing of the SCRs 58–60 and 68–70.

The inductance of the windings 10 and 12 and the capacitive reactance of the capacitors 66 and 72 may be selected so as to cause the tank circuit to oscillate at a frequency of about 415 Hz when stimulated. It is to be understood, however, that this frequency is set out for exemplary purposes only and it should not be construed as in any way limitive of the invention. The SCRs 58–60 and 68–70 are turned on and off via the microprocessor control in such a manner to produce fields in the coils 10 and 12 which are 90° out-of-time phase with respect to one another. Timing information for the microprocessor as well as field amplitude feedback is provided by the Hall sensors 78 and 80. These sensors are physically positioned relative to their associated coils so as to detect only the magnetic field produced by its associated field coil. The output from the Hall sensors are fed to the signal processing circuits of FIG. 3. The waveforms set out in FIG. 4 show the time relationship between the oscillating field and the time at which the sample and hold circuit 86 is triggered and the A/D converter 90 is enabled to provide its digital output to the microprocessor. It can be seen that the output from the zero-crossing detector 88 when applied to an interrupt input of the microprocessor in effect advises the microprocessor that the field being sensed by the appropriate Hall sensor is at a maximum while the field produced by the other coil at this same time should be zero. The digital value indicative of the field amplitude at the time of sampling is fed to the microprocessor and compared to a profile stored in the memory circuits of the microprocessor and the number of current pulses from the inverter fed to the tank circuit is controlled by the appropriate application of triggering pulses to the SCRs 58–60 and 68–70 by the microprocessor so that the field amplitude can be tailored to match the desired stored profile.

If it is assumed that the coils 10 and 12 are physically orthogonally disposed and that the oscillating fields produced by current flows through these coils are 90° out-of-phase with respect to one another, then a circular rotating field of an adjustable magnitude is produced. Such a field is extremely efficacious for reducing the remanent magnetization of an item being degaussed to zero. However, if it is desired to leave a predetermined level of remanent magnetization by having the magnetic domains oriented in a desired fashion other than purely random, then the microprocessor can be programmed to cause the currents flowing in the field coils to be at phase angles other than 90°, resulting in an elliptical rotation of the magnetization vector rather than a circular rotation.

The controlled switching of the SCRs 30 and 32 provide an energy storage arrangement which exhibits low average and low peak power consumption. When the system is not functioning to perform the demagnetization function, the capacitor 34 merely stores up energy which will later be released when the inverter is made to operate by the controlled switching of the SCRs 42 and 44. This is to be contrasted with systems in which the demagnetizing field is generated by continuously applying current from the power company's line through dissipative elements of phase shift networks. Also, by using an air core rather than a magnetic core, the present invention does not involve hysteresis and eddy current losses in the iron nor are third harmonics produced. As mentioned earlier, third harmonic currents tend to disrupt the uniformity of demagnetization vector in those prior art systems which employ ferrous metal core pieces.

Being microprocessor controlled, the system of the present invention allows ready adjustment of the frequency upon any changes in the inductance of the field coils occasioned by the introduction of ferrous materials to be demagnetized. Thus, inductive changes do not distort or destroy the uniformity of the resultant demagnetizing field.

The present invention is extremely well suited for treating magnetic recording media, such as flexible diskettes, disk packs and magnetic recording tape. By providing absolute elimination of all remanent magnetization within the recording materials, extra pulse and peak shift errors in systems employing the media are reduced. Where information is recorded accurately to base line levels with a minimum of distortion, it insures that recording media can be successfully interchanged among different drive and playback devices. The demagnetization provided by the apparatus of the present invention reduces the initial percentage of the total available interchange margin to greater accommodate marginal drives, such as those with worn or dirty heads or heads which are displaced from nominal alignment. Dealing with analog recording tapes, demagnetization afforded by the system of the present invention improves the signal-to-noise ratio of the media and thereby improves the quality of the sound reproduced by the media.

Because the apparatus of the present invention does not use ferrous pole pieces, the amplitude of the demagnetizing field is not limited by saturation characteristics of the iron. Thus, higher amplitude magnetic fields can be produced, allowing bulk demagnetization of large volume items. Multiple flexible diskettes, reels of mag tape can be placed in the chamber 14 and treated simultaneously.

While there is no intrinsic limit on the depth of erasure, using the technique of the present invention, a system has been provided allowing depth of erasure of −90 db below saturation level with less than 0.5 db of circular nonuniformity. In that the microprocessor can be programmed to produce a variety of ramp-up and ramp-down profiles, optimization of erasure in specific applications is attainable.

With the foregoing description of the preferred embodiment in hand, persons of ordinary skill in programming a microprocessor such as the Intel 8085 microprocessor will be readily able to develop the detailed machine coding for allowing the internal timing registers of the microprocessor to issue the $S_1$ to $S_8$ gate or trigger signals at appropriate times to cause the desired field currents to flow. Thus, it is believed unnecessary to set out in detail herein the assembly language or machine coding employed.

It can be seen, therefore, that this invention provides significant improvement and advantages over known prior art demagnetizing systems. While there has been shown and described a preferred embodiment of the invention, it is to be understood that alterations may be made to the specific circuit configuration without departing from the true spirit and scope of the invention. Therefore, it is the intent that the scope of the invention be determined from the following claims.

What is claimed is:

1. Apparatus for demagnetizing items exhibiting a remanent magnetic field comprising:

(a) a hollow chamber made from a non-ferromagnetic material that is substantially transparent to magnetic fields, said chamber being surrounded at least over a part of its surface by first and second coils, said first and second coils being orthogonally disposed relative to one another and each forming a part of first and second resonant tank circuits;

(b) a source of current pulses for stimulating said tank circuits;

(c) controllable switching means coupled between said first and second resonant tank circuits and said source of current pulses; and (d) microprocessor means coupled to said controllable switching means for rendering said switching means conductive and nonconductive at preprogrammed times to maintain a predetermined phase relationship between the magnetic fields produced by currents flowing through said first and second coils.

2. The apparatus as in claim 1 and further including:

(e) means for sensing the instantaneous magnitude of said magnetic field; and (f) means for applying a digitized value of the magnitude of said magnetic field to data input terminals of said microprocessor means.

3. The apparatus as in claim 2 wherein said means for applying a digitized value of the magnitude of said magnetic field to data input terminals of said microprocessor means comprises:

(g) amplifier means coupled to said means for sensing;

(h) a differentiating circuit connected to receive the output from said amplifier means;

(i) a zero-crossing detector circuit connected to the output of said differentiating circuit;

(j) a sample and hold circuit connected to the output of said zero-crossing detector and to the output of said amplifier means for capturing the output of said amplifier means at the time said zero-crossing detector output occurs; and (k) analog-to-digital converter means coupled to receive an analog signal from said sample & hold circuit and provide a digital quantity to said microprocessor means corresponding to the amplitude of said analog signal.

4. The apparatus as in claim 1 wherein said source of current pulses comprises:

(l) a source of alternating current;

(m) means for converting said alternating current to direct current;

(n) energy storage means connected to receive said direct current; and (o) inverter means coupled to said energy storage means and to said microprocessor means for producing square wave pulses at a rate determined by said microprocessor means.

5. The apparatus as in claim 4 and further including:

(p) analog-to-digital converter means connected to receive an analog voltage from said energy storage means and for providing a digital value indicative of said analog voltage to said microprocessor means.

6. The apparatus as in claim 5 wherein said microprocessor means is coupled to said means for converting alternating current to direct current for controlling the electrical energy supplied to said energy storage means whereby the amplitude of said square wave pulses is controlled by said microprocessor means.

7. The apparatus as in claim 1 wherein said first and second coils are circularly wound to conform a generally spherical surface.

* * * * *